US006802939B1

(12) United States Patent
Donnelly et al.

(10) Patent No.: US 6,802,939 B1
(45) Date of Patent: Oct. 12, 2004

(54) AQUEOUS POLYMERIC EMULSION COMPOSITIONS AND THEIR USE FOR THE SIZING OF PAPER

(75) Inventors: Simon Donnelly, Shipley (GB); John Robert Stockwell, Skipton (GB); John Plonka, Leeds (GB)

(73) Assignee: Ciba Specialty Chemicals Water Treatments Limited, Bradford (GB)

( * ) Notice: Subject to any disclaimer, the term of this patent is extended or adjusted under 35 U.S.C. 154(b) by 0 days.

(21) Appl. No.: 09/889,889

(22) PCT Filed: Jan. 12, 2000

(86) PCT No.: PCT/EP00/00160

§ 371 (c)(1),
(2), (4) Date: Jul. 23, 2001

(87) PCT Pub. No.: WO00/44983

PCT Pub. Date: Aug. 3, 2000

(30) Foreign Application Priority Data

Jan. 26, 1999 (GB) ..... 9901597

(51) Int. Cl.[7] ..... D21H 17/07; D21H 17/09; D21H 21/16

(52) U.S. Cl. ..... 162/135; 162/168; 162/168.2; 162/168.3; 162/164.5; 524/714; 524/742; 524/750; 524/796

(58) Field of Search ..... 162/164.5, 168.1, 162/168.2, 168.3; 524/167, 236, 609, 714

(56) References Cited

U.S. PATENT DOCUMENTS

| | | | | |
|---|---|---|---|---|
| 4,659,431 A | * | 4/1987 | Probst et al. | 162/169 |
| 4,904,727 A | | 2/1990 | Probst et al. | 524/820 |
| 6,287,418 B1 | * | 9/2001 | Schroeder et al. | 162/112 |

FOREIGN PATENT DOCUMENTS

| | | |
|---|---|---|
| DE | 2604547 | 8/1977 |
| DE | 3047688 | 7/1982 |
| EP | 0320594 | 6/1989 |
| EP | 0400410 | 12/1990 |
| EP | 0744417 | 11/1996 |
| EP | 0763628 | 3/1997 |
| GB | 1479913 | 7/1977 |
| WO | 97/37078 | 10/1997 |

OTHER PUBLICATIONS

Patent Abstracts of Japan vol. 006, No. 197, JP 57108103 (1982).
Derwent Abstr. 1990–362971 for EP 400410 (1990).
Derwent Abstr. 1982–61729E [30] for DE 3047688 (1982).
Derwent Abstr. 1977–57813Y [33] for DE 2604547 (1977).
Derwent Abstr. 1994–253469 [31] for JP 06184990 (1994).
Derwent Abstr. 1992–059805 for JP 04059805 (1992).
Patent Abstr. of Japan 94–269868 [33] for JP 6200499 (1994).

* cited by examiner

*Primary Examiner*—Peter Chin
(74) *Attorney, Agent, or Firm*—David R. Crichton; Kevin T. Mansfield

(57) ABSTRACT

A method of sizing paper by applying a composition comprising an aqueous dispersion of polymeric particles of particle size up to 1 micron, preferably 80–200 nm, wherein the polymeric particles comprise a water insoluble polymer matrix, preferably formed from styrene and 2-ethylhexyl acrylate, characterized in that an oligomer formed from a monomer blend comprising, (a) (meth)acrylamide, and (b) organic mercaptan or an organic sulphone, preferably dodecyl mercaptan or dodecyl sulphone is located at the surface of the particles. Compositions where the oligomer further comprises an ethylenically unsaturated monomer comprising either a tertiary amine group or a quaternary ammonium group, preferably dimethylaminoethylmethacrylate are novel.

Advantages of the composition when applied to the surface of paper, include improved water resistance, brightness and printability properties of the treated paper.

24 Claims, No Drawings

AQUEOUS POLYMERIC EMULSION COMPOSITIONS AND THEIR USE FOR THE SIZING OF PAPER

The present invention relates to novel compositions comprising an aqueous dispersion of water insoluble polymer particles, wherein the polymer particles further comprise at their surface an oligomeric compound. The invention also encompasses a method of sizing paper and a method for improving the printability of paper.

It is known to produce dispersions of water insoluble polymer particles by emulsion polymerisation or by suspension polymerisation. In such processes it would be usual to disperse a water insoluble monomer or monomer blend into an aqueous continuous phase to form droplets of monomer. In aqueous emulsion polymerisation or aqueous suspension polymerisation it is standard practice to use surface active ingredients such as emulsifiers, surfactants or polymerisation stabilisers. Typically such compounds would have a high Hydrophilic Lipophilic Balance (HLB) so that the compound would partition preferentially in the aqueous continuous phase.

It is known to use oligomeric compounds as emulsifiers or polymerisation stabilisers in the emulsion polymerisation of water insoluble monomers such as styrene, acrylonitrile, ethyl acrylate and butyl acrylate and the like. Such compositions have been produced as rubber or plastic latexes from which the solid polymer could be obtained. Generally such compositions were produced in order to provide products that exhibited low viscosity and reduced foaming characteristics and yet were able to form suitable solid rubber or plastic materials.

It is standard practice in the field of paper and board manufacture to both internally and externally size paper. The sizing agent imparts hydrophobicity to the paper or paper board and improves the resistance to penetration by liquids, especially water. Internal sizing is normally achieved by incorporating a sizing agent into the paper making stock prior to draining on the machine wire. The sizing agent may be a non-reactive size such as rosin, but more usually is a reactive size such as alkenyl succinic anhydride (ASA). ASA would easily be dispersed throughout the cellulosic suspension and chemically reacts with the cellulose and is therefore generally regarded as a very efficient sizing agent. However, due to the reactivity of ASA size, and the ease with which it easily hydrolyses the aqueous sizing emulsions are normally made up in situ. If hydrolysis of the ASA anhydride groups take place to any significant degree before application, this could result in gummy deposits which would damage paper formation and in severe cases stop paper production. Therefore care has to be taken when applying reactive size.

It is known to use various hydrophobic materials such as waxes and water insoluble polymers and reactive sizes, such as ASA as paper surface sizing compositions. Generally such compositions are prepared as aqueous dispersions or emulsions and are blended with other materials such as starch prior to being applied to the paper sheet at the size press. It is important to impart the right degree of hydrophobicity and thus water resistance without impairing the brightness of the paper. It is often the case that a product that imparts optimum hydrophobicity significantly reduces brightness. Often it is necessary to strike a compromise between hydrophobicity and brightness and the product that is chosen does not impair brightness too significantly and yet provides adequate water resistance. Where products provide maximum water resistance to the paper, the resolution of images during printing would normally be improved. However, any significant reduction in paper brightness would mean that there would also be a poor contrast between the paper and image.

It would therefore be desirable to provide a paper sizing composition which imparts significantly improved hydrophobicity and printability characteristics and yet does not significantly reduce the brightness of the paper or board.

Thus a method of sizing paper or paper board is provided wherein a composition (A) is applied to at least one of, i) the surface of a formed paper or paper board sheet, ii) a paper or paper board making cellulosic suspension prior to draining, wherein the composition (A) comprisies an aqueous dispersion of polymeric particles of particle size up to 1 micron, wherein the polymeric particles comprise a water insoluble polymer matrix, comprising characterised in that an oligomer formed from a monomer blend comprised of ethylenically unsaturated monomer or ethylenically unsaturated monomer blend, (a) (meth)acrylamide and (b) an organic mercaptan or organic sulphone, is located at the surface of the polymer particles.

It has been found that the application of composition (A) to a paper making stock prior to draining on the machine wire produces effective internally sized paper. The composition (A) may be applied as the neat polymer dispersion as a single addition to the paper making stock or may be combined with for instance the retention, drainage aids or strength aids. Often it is preferred to apply the composition as a formulation in pre cooked starch. Typically the formulation would comprise 90–99.5 weight % starch and 0.5–10 weight % polymer particles, preferably 92.5–97.5 weight % starch and 2.5–7.5 weight % polymer particles, more preferably 95–97.5 weight % starch and 2.5–5 weight % polymer particles, based on total dry weight of starch and polymer particles. It has surprisingly been found that the composition can be used to form internally sized paper with superior properties.

Composition (A) is particularly suited for surface sizing of paper and provides unique properties to the paper. Incorporated in the method of sizing paper or board composition (A) is applied to the surface of a formed sheet of paper or paper board. Often it is preferred to apply the composition as a formulation in pre cooked starch. Typically the formulation would comprise 90–99.5 weight % starch and 0.5–10 weight % polymer particles, preferably 92.5–97.5 weight % starch and 2.5–7.5 weight % polymer particles, more preferably 95–97.5 weight % starch and 2.5–5 weight % polymer particles, based on total dry weight of starch and polymer particles. Although the composition (A) would be desirably applied as a blend with starch it may also be applied as a neat aqueous dispersion of polymer particles. In addition to combining composition (A) with starch it may also be desirable to combine other ingredients normally applied during surface sizing, for instance Optical Brightening Agents (OBA). Normally the neat composition is applied at the size press in order to achieve maximum benefits of the sizing method disclosed herein.

Preferably in the method of sizing paper and paper board the composition comprises an aqueous dispersion of polymeric particles of particle size up to 1 micron, wherein the polymeric particles comprise a water insoluble polymer matrix and at the surface an oligomer formed from a monomer blend comprising, (a) (meth)acrylamide, (b) an organic mercaptan or organic sulphone, (c) an ethylenically unsaturated monomer comprising either a tertiary amine group or a quaternary ammonium group and (d) optionally other monomers.

The oligomer comprised in the composition used in the method of sizing paper may incorporate any organic mercaptan or organic sulphone but is preferably $C_{1-20}$ optionally substituted alkyl mercaptans, $C_{1-20}$ optionally substituted alkyl sulphones, optionally substituted $C_{5-7}$ cycloalkyl mercaptans, optionally substituted aromatic mercaptans, optionally substituted $C_{5-7}$ cycloalkyl sulphones or optionally substituted aromatic sulphones are preferred. More preferred are $C_{8-20}$ alkyl mercaptans, $C_{5-7}$ cycloalkyl mercaptans, aromatic mercaptans, $C_{8-20}$ alkyl sulphones, $C_{5-7}$ cycloalkyl sulphones or aromatic sulphones. Particularly preferred is either dodecyl mercaptan or dodecyl sulphone. Suitable substituted alkyl mercaptans include 3-mercaptopropanoic acid, 2-mercaptoethanol whilst 2-sulphonylethanol and 3sulphonylpropanoic acid are suitable substituted alkylsulphones. The amount of organic mercaptan or organic sulphone used in the oligomer is normally up to 10 mole %. It may be possible to use more than one organic mercaptan and/or organic sulphone in the preparation of the oligomer, although the combined molar proportions of organic mercaptan(s) and/or organic sulphone (s) is generally up to 10 mole %. Preferably the level of organic mercaptan or organic sulphone compounds is in the range 2.5–5 mole %.

In the method of sizing paper or board the oligomer comprises any of ethylenically unsaturated tertiary amine or quaternary ammonium compounds into the oligomer, but preferred compounds are represented by compounds formula (1)

$$CH_2{=}CR{-}Q \qquad (1)$$

wherein

Q is $-C(O)-Z-A$, $-CH_2-N^+R_1R_3CH_2CR{=}CH_2\ X^-$ or $-CH_2NR_1CH_2CR{=}CH_2$,

Z is —O— or —NH—,

A is $-C_nH_{2n}-B$, n is an integer from 1 to 4,

B is $-NR_1R_2$ or $-N^+R_1R_2R_3\ X^-$,

R is —H or $-CH_3$, $R_1$ is $C_{1-4}$ alkyl, $R_2$ is $C_{1-4}$ alkyl, $R_3$ is —H or $C_{1-8}$ alkyl, $C_{5-7}$ cycloalkyl or benzyl, and $X^-$ is anion, preferably halide, most preferably chloride.

Preferred ethylenically unsaturated tertiary amine or ethylenically unsaturated quaternary ammonium compounds include for instance dimethylaminoethyl (meth)acrylate, acid addition salt or quaternary ammonium salt thereof, preferably dimethylaminoethyl (meth)acrylate, methyl chloride quaternary ammonium salt or dimethylaminoethyl (meth)acrylate, benzyl chloride quaternary ammonium salt.

Normally the level of ethylenically unsaturated tertiary amine or ethylenically unsaturated quaternary ammonium compounds to be incorporated into the oligomer is up to 10 mole %. Preferably these compounds are present in the oligomer in amounts in the range 2.5–5 mole %.

The oligomer compound normally contains higher levels of acrylamide or methacrylamide components. For instance the molar proportion of (meth)acrylamide is usually at least 85 mole % and is preferably at least 90 mole %. Typically the molar proportion of (meth)acrylamide is between 90 and 97.5 mole %, preferably 92.5–95 mole %.

It is also possible incorporate other ethylenically unsaturated monomers into the oligomer. In particular it is possible to incorporate up to 10 mole % ethylenically unsaturated carboxylic acid or ethylenically unsaturated carboxylic anhydride. This may be for instance acrylic acid or maleic anhydride preferably used in an amount between 2.5 and 5 mole %.

In the method of sizing paper the composition applied to the surface of the paper or board sheet further comprises polymeric particles are comprised of ethylenically unsaturated monomer or ethylenically unsaturated monomer blend, which monomer or monomer blend are substantially water insoluble at room temperature. The monomers polymerise to provide polymers that are substantially water insoluble at room temperature. Desirably the monomer or monomer blend has a solubility in water at 25° C. of less than 5%. The monomers may be an ester of an ethylenically unsaturated carboxylic acid, styrene, alkyl styrene, (meth)acrylonitrile, vinyl carboxylate etc. Typically the matrix of the polymeric particles are formed from a monomer or a monomer blend comprising monomers selected from the group consisting of styrene, $C_{1-12}$ alkyl (meth)acrylate, vinyl acetate, acrylonitrile. Preferably the matrix of the polymer particles is formed from 25–75 weight % monomer or monomer blend selected from any of styrene, acrylonitrile, vinyl acetate or $C_{1-2}$ alkyl (meth) acrylate, preferably styrene, acrylonitrile, methyl methacrylate, methyl acrylate, ethyl methacrylate, vinyl acetate and 25–75 weight % monomer or monomer blend selected from any $C_{3-12}$ alkyl (meth)acrylates, preferably butyl acrylate, n-hexyl acrylate, n-octyl acrylate and 2-ethylhexyl acrylate. More preferably the matrix of the polymer particles is formed from 25–75 weight %, preferably 35–65 weight %, most preferably 50 weight % styrene and 25–75 weight %, preferably 35–65 weight %, most preferably 50 weight % 2-ethylhexyl acrylate. In another preferred aspect the polymer particles have a minimum film forming temperature of between −5 and 55° C., preferably between 25 and 45° C., most preferably about 35° C. It may also be desirable to combine cross linking monomer into the monomer blend. The cross linking monomer can be any polyethylenically unsaturated monomer, for instance divinyl benzene, ethylene glycol dimethacrylate or triallyl amine. Typically the amount of cross linking monomer used would be below 1% by weight based on total weight of monomer, for instance in the range 0.25–0.50 weight %. Generally the composition used in the method of sizing paper or board comprises polymer particles which have a particle size in the range 80–200 nm, preferably 100–120 nm.

In the method of sizing paper the blend of starch and polymer particles would be applied to the surface of the formed sheet of paper at a dose of up to 20 g/m$^2$, preferably up to 10 g/m$^2$, typically around 3 g/m$^2$.

The method of sizing paper or paper board provides paper with good water resistance properties in combination with surprisingly high levels of paper brightness. Furthermore, the size can conveniently be applied in sizing formulations of pH from as low as 1 to as high as 12 and still provide acceptable results.

A further aspect of the invention includes a method of improving the printability of a sheet of paper by applying to the surface of the formed sheet of paper a composition comprising an oligomer formed from a monomer blend comprising, (a) (meth)acrylamide, (b) an organic mercaptan or organic sulphone, (c) an ethylenically unsaturated monomer comprising either a tertiary amine group or a quaternary ammonium group, and (d) optionally other monomers.

In the method of improving printability of paper the oligomer would be applied directly to the formed sheet of paper at a dose of up to 20 g/m$^2$, preferably up to 10 g/m$^2$, typically around 3 g/m$^2$.

In the method of improving the printability of a sheet of paper, the oligomer, comprised in the composition may comprise any organic mercaptan or organic sulphone, generally $C_{1-20}$ optionally substituted alkyl mercaptans, $C_{1-20}$ optionally substituted alkyl sulphones, optionally substituted $C_{5-7}$ cycloalkyl mercaptans, optionally substituted aromatic mercaptans, optionally substituted $C_{5-7}$ cycloalkyl sulphones or optionally substituted aromatic sulphones are preferred. More preferred are $C_{8-20}$ alkyl mercaptans, $C_{5-7}$ cycloalkyl mercaptans, aromatic mercaptans, $C_{8-20}$ alkyl sulphones, $C_{5-7}$ cycloalkyl sulphones or aromatic sulphones. Particularly preferred is either dodecyl mercaptan or dodecyl sulphone.

In the method of improving printability the amount of organic mercaptan or organic sulphone used in the oligomer used in the compostion is normally up to 10 mole %. It may be possible to use more than one organic mercaptan and/or organic sulphone in the preparation of the oligomer, although the combined molar proportions of organic mercaptan(s) and/or organic sulphone(s) is generally up to 10 mole %. Preferably the level of organic mercaptan or organic sulphone compounds is in the range 2.5–5 mole %. Preferably the oligomer used in the paper sizing composition comprises $C_{8-20}$ alkyl mercaptans, $C_{5-7}$ cycloalkyl mercaptans, aromatic mercaptans, $C_{8-20}$ alkyl sulphones, $C_{5-7}$ cycloalkyl mercaptans or aromatic sulphones. Suitable substituted alkyl mercaptans include 3-mercaptopropanoic acid, 2-mercaptoethanol whilst 2-sulphonylethanol and 3-sulphonylpropanoic acid are suitable substituted alkylsulphones. Most preferably the paper sizing composition comprises an oligomer comprising either dodecyl mercaptan or dodecyl sulphone. The oligomer incorporated in paper sizing composition comprises the organic mercaptan or organic sulphone in an amount up to 10 mole %, preferably 2.5–5 mole %.

In the method of improving the printability of paper or board the oligomer comprises ethylenically unsaturated tertiary amine or quaternary ammonium compounds into the oligomer, but preferred compounds are represented by compounds formula (1) given before in the specification and wherein the same preferences apply.

Preferred ethylenically unsaturated tertiary amine or ethylenically unsaturated quaternary ammonium compounds include for instance dimethylaminoethyl (meth)acrylate, acid addition salt or quaternary ammonium salt thereof, preferably dimethylaminoethyl (meth)acrylate, methyl chloride quaternary ammonium salt or dimethylaminoethyl (meth)acrylate, benzyl chloride quaternary ammonium salt.

In the method of improving the printability of paper the oligomer would preferably comprise ethylenically unsaturated tertiary amine or ethylenically unsaturated quaternary ammonium compounds to be incorporated into the oligomer is up to 10 mole %. Preferably these compounds are present in the oligomer in amounts in the range 2.5–5 mole %. The oligomer compound normally contains higher levels of acrylamide or methacrylamide components. For instance the molar proportion of (meth)acrylamide is usually at least 85 mole % and is preferably at least 90 mole %. It is also possible incorporate other ethylenically unsaturated monomers into the oligomer. In particular it is possible to incorporate up to 10 mole % other ethylenically unsaturated monomers into the oligomer. In particular it is possible to incorporate up to 10 mole % ethylenically unsaturated carboxylic acid or ethylenically unsaturated carboxylic anhydride. This may be for instance acrylic acid or maleic anhydride preferably used in an amount between 2.5 and 5 mole %.

In a particularly preferred method of improving printability of paper the oligomer is comprised in an aqueous dispersion of polymer particles. The oligomer would be present at the surface of the polymer particles wherein the matrix of the polymer particles are derived from ethylenically unsaturated monomer or ethylenically unsaturated monomer blend, which monomer or monomer blend are substantially water insoluble at room temperature. The monomers polymerise to provide polymers that are substantially water insoluble at room temperature. Typically the matrix of the polymeric particles are formed from a monomer or a monomer blend comprising monomers selected from the group consisting of styrene, $C_{1-12}$ alkyl (meth) acrylate, vinyl acetate, acrylonitrile. Preferably the matrix of the polymer particles is formed from 25–75 weight % monomer or monomer blend selected from any of styrene, acrylonitrile, vinyl acetate or $C_{1-2}$ alkyl (meth)acrylates, preferably styrene, acrylonitrile, methyl methacrylate, methyl acrylate, ethyl methacrylate, vinyl acetate and 25–75 weight % monomer or monomer blend selected from any of $C_{3-12}$ alkyl (meth)acrylates, preferably n-butyl acrylate, n-hexyl acrylate, n-octyl acrylate and 2-ethylhexyl acrylate. More preferably the matrix of the polymer particles is formed from 25–75 weight %, preferably 35–65 weight %, most preferably 50 weight % styrene and 25–75 weight %, preferably 35–65 weight %, most preferably 50 weight % 2-ethylhexyl acrylate. In another preferred aspect the polymer particles have a minimum film forming temperature of between −5 and 55° C., preferably between 25 and 45° C., most preferably about 35° C. Generally the composition used in the method of sizing paper or board comprises polymer particles which have a particle size in the range 80 to 200 nm, preferably 100–120 nm.

In a preferred method of improving the printability of paper a blend of starch and an aqueous dispersion of polymeric particles of particle size up to 1 micron, preferably 80–200 nm, more preferably 100–120 nm, wherein the polymeric particles comprise a water insoluble polymer matrix characterised in that an oligomer formed from a monomer blend comprising, (a) (meth)acrylamide, (b) an organic mercaptan or organic sulphone, (c) an ethylenically unsaturated monomer comprising either a tertiary amine group or a quaternary ammonium group and (d) optionally other monomers and an ethylenically unsaturated monomer comprising either a tertiary amine group or a quaternary ammonium group comprises one or more compounds of formula (1) given before in the specification and wherein the same preferences apply.

Typically in the method of improving printability of paper the oligomer comprised in the composition applied to the surface of the formed sheet of paper comprises the compound of formula (1) in an amount up to 10 mole %, preferably 2.5–5 mole %. Ideally the oligomer is formed from a monomer blend comprising, one or more compounds selected from the list comprising dimethylaminoethyl (meth)acrylate, acid addition salt or quaternary ammonium salt thereof, preferably dimethylaminoethyl (meth)acrylate, methyl chloride quaternary ammonium salt or dimethylaminoethyl (meth)acrylate, benzyl chloride quaternary ammonium salt. Preferably the oligomer formed from a monomer blend comprising acrylamide or methacrylamide in an amount of at least 85 mole, preferably at least 90 mole %. The oligomer incorporated in the paper sizing composition may comprise as an additional ethylenically unsaturated monomer. In particular it is possible to incorporate up to 10 mole % ethylenically unsaturated carboxylic acid or ethylenically unsaturated carboxylic anhydride. This may be for instance acrylic acid or maleic anhydride preferably used in an amount between 2.5 and 5 mole %.

The invention relates to a method of improving printability of paper by applying to the surface of the paper a blend comprising starch, optionally optical brighteners and an aqueous dispersion of the polymeric particles which are formed from a monomer or a monomer blend comprising monomers selected from the group consisting of styrene, $C_{1-12}$ alkyl (meth)acrylate, vinyl acetate and acrylonitrile. Preferably the matrix of the polymer particles is formed from 25–75 weight %, preferably 35–65 weight %, most preferably 50 weight %, monomer or monomer blend selected from the group consisting of styrene, acrylonitrile, vinyl acetate and $C_{1-2}$ alkyl (meth)acrylates, preferably styrene, acrylonitrile, methyl methacrylate, methyl acrylate, ethyl methacrylate, vinyl acetate and 25–75 weight %, preferably 35–65 weight %, most preferably about 50 weight %, monomer or monomer blend selected from any of $C_{3-12}$ alkyl (meth)acrylates, preferably n-butyl acrylate, n-hexyl acrylate, n-octyl acrylate and 2-ethylhexyl acrylate. Most preferably the matrix of the polymer particles is formed from 25–75 weight %, preferably 35–65 weight %, most preferably 50 weight % styrene and 25–75 weight %, preferably 35–65 weight %, most preferably about 50 weight % 2-ethylhexyl acrylate.

The method of improving printability of paper desirably involves applying to the surface of a formed sheet of paper a blend of starch and polymer particles that have a minimum film forming temperature of between −5 and 55° C., preferably between 25 and 45° C., most preferably about 35° C. The polymer particles comprised in the paper sizing composition desirably have a particle size below 1 micron, preferably in the range 80 to 200 nm, more preferably 100–120 nm. Ideally the blend of starch and polymer particles, comprise 0.5 to 10 wt % polymer particles and 90 to 99.5 wt. % starch, based on dry weight of the blend.

In the method of improving printability the blend of starch and polymer particles would be applied to the surface of the formed sheet of paper at a dose of up to 20 g/m$^2$, preferably up to 10 g/m$^2$, typically around 3 g/m$^2$.

In the method of improving printability of paper, it has surprisingly been found that the paper treated by this method has an acceptable level of water resistance in combination with a high degree of paper brightness and when used in for instance non-impact printing, provides superior printability properties. Furthermore, the size can conveniently be applied in sizing formulations of pH from as low as 1 to as high as 12 and still provide acceptable results.

One aspect the invention encompasses a novel composition comprising an aqueous dispersion of polymeric particles of particle size up to 1 micron, wherein the polymeric particles comprise a water insoluble polymer matrix and at the surface an oligomer formed from a monomer blend comprising, (a) (meth)acrylamide, (b) an organic mercaptan or organic sulphone, (c) an ethylenically unsaturated monomer comprising either a tertiary amine group or a quaternary ammonium group and (d) optionally other monomers.

Although any organic mercaptan or organic sulphone may be present in the oligomer, generally $C_{1-20}$ optionally substituted alkyl mercaptans, $C_{1-20}$ optionally substituted alkyl sulphones, optionally substituted $C_{5-7}$ cycloalkyl mercaptans, optionally substituted aromatic mercaptans, optionally substituted $C_{5-7}$ cycloalkyl sulphones or optionally substituted aromatic sulphones are preferred. Suitable substituted alkyl mercaptans include 3-mercaptopropanoic acid, 2-mercaptoethanol whilst 2-sulphonylethanol and 3sulphonylpropanoic acid are suitable substituted alkylsulphones. More preferred are $C_{8-20}$ alkyl mercaptans, $C_{5-7}$ cycloalkyl mercaptans, aromatic mercaptans, $C_{8-20}$ alkyl sulphones, $C_{5-7}$ cycloalkyl sulphones or aromatic sulphones. Particularly preferred is either dodecyl mercaptan or dodecyl sulphone.

The amount of organic mercaptan or organic sulphone used in the oligomer is normally up to 10 mole %. It may be possible to use more than one organic mercaptan and/or organic sulphone in the preparation of the oligomer, although the combined molar proportions of organic mercaptan(s) and/or organic sulphone(s) is generally up to 10 mole %. Preferably the level of organic mercaptan or organic sulphone compounds is in the range 2.5 to 5 mole %.

It would be possible to incorporate any number of ethylenically unsaturated tertiary amine or ethylenically unsaturated quaternary ammonium compounds into the oligomer, but preferred compounds are represented by compounds of formula (1) given before in the specification and wherein the same preferences apply.

Preferred ethylenically unsaturated tertiary amine or ethylenically unsaturated quaternary ammonium compounds include for instance dimethylaminoethyl (meth)acrylate, acid addition salt or quaternary ammonium salt thereof, preferably dimethylaminoethyl (meth)acrylate, methyl chloride quaternary ammonium salt or dimethylaminoethyl (meth)acrylate, benzyl chloride quaternary ammonium salt.

Normally the level of ethylenically unsaturated tertiary amine or ethylenically unsaturated quaternary ammonium compounds to be incorporated into the oligomer is up to 10 mole %. Preferably these compounds are present in the oligomer in amounts in the range 2.5 to 5 mole %.

The oligomer compound normally contains higher levels of acrylamide or methacrylamide components. For instance the molar proportion of (meth)acrylamide is usually at least 85 mole % and is preferably between 90 mole % and 97.5 mole %, preferably 92.5 mole % to 95 mole %.

It is also possible incorporate other ethylenically unsaturated monomers into the oligomer. In particular it is possible to incorporate up to 10 mole % ethylenically unsaturated carboxylic acid or ethylenically unsaturated carboxylic anhydride. This may be for instance acrylic acid or maleic anhydride preferably used in an amount between 2.5 and 5 mole %.

Generally speaking the matrix of the polymeric particles are comprised of ethylenically unsaturated monomer or ethylenically unsaturated monomer blend, which monomer or monomer blend is substantially water insoluble at room temperature. The monomers polymerise to provide polymers that are substantially water insoluble at room temperature. Typically the matrix of the polymeric particles are formed from a monomer or a monomer blend comprising monomers selected from the group consisting of styrene, $C_{1-12}$ alkyl (meth)acrylate, vinyl acetate, acrylonitrile. Preferably the matrix of the polymer particles is formed from 25–75 weight % monomer or monomer blend selected from any of styrene, acrylonitrile, vinyl acetate or $C_{1-2}$ alkyl (meth)acrylates, especially styrene, acrylonitrile, methyl methacrylate, methyl acrylate, ethyl methacrylate and vinyl acetate and 25–75 weight % monomer or monomer blend selected from any of $C_{3-12}$ alkyl (meth)acrylates, especially butyl acrylate, n-hexyl acrylate, n-octyl acrylate and 2-ethylhexyl acrylate. More preferably the matrix of the polymer particles is formed from 25–75 weight %, preferably 35 to 65 weight %, most preferably about 50 weight % styrene and 25–75 weight %, preferably 35 to 65 weight %, most preferably about 50 weight % 2-ethylhexyl acrylate. In another preferred aspect the polymer particles have a minimum film forming temperature of between −5 and 55° C., preferably between 25 and 45° C., most preferably about 35° C. Generally the composition comprises a dispersion of polymer particles which have a particle size in the range 80–200 nm, preferably 100–120 nm.

Thus the invention encompasses an aqueous dispersion of polymer particles, wherein the polymer particles have a particle size in the range 80–200 nm, preferably 100–120 nm and comprising a matrix of water insoluble polymer, preferably formed from ethylenically unsaturated water insoluble monomers, more preferably formed from 25–75 wt. %, usually around 50 wt. %, of one or more monomers selected from styrene, acrylonitrile, methyl methacrylate, vinyl acetate, especially styrene and 25–75 wt. %, usually around 50 wt. %, of one or more monomers selected from butyl acrylate, n-hexyl acrylate, 2-ethylhexyl acrylate and n-octyl acrylate, especially 2-ethylhexyl acrylate, characterised in that the polymer particles also comprise at their surface an oligomer of acrylamide or methacrylamide which additionally comprises an organic mercaptan or organic sulphone, preferably a $C_{8-20}$ alkyl mercaptan or $C_{8-20}$ alkyl sulphone, more preferably dodecyl mercaptan or dodecyl sulphone. Preferably the oligomer also comprises components based on ethylenically unsaturated tertiary amines or ethylenically unsaturated quaternary ammonium compounds, for instance dimethylaminoethyl methacrylate methyl chloride quaternised or dimethylaminoethyl methacrylate benzyl chloride quaternised. It is also possible incorporate other ethylenically unsaturated monomers into the oligomer. In particular it is possible to incorporate up to 10 mole % ethylenically unsaturated carboxylic acid or ethylenically unsaturated carboxylic anhydride. This may be for instance acrylic acid or maleic anhydride preferably used in an amount between 2.5 and 5 mole %.

The novel composition could be used in the coating of various substrates, but the compositions are desirably paper and paper board sizing agents or paper coating materials that can improve water resistance and/or printability of paper. Generally the novel compositions are blended with other materials such as solutions of natural or synthetic water soluble or water swellable polymers to form sizing or coating formulations.

The oligomer is made by mixing together the components with water and optionally other solvents, for instance alcohols such as ethanol or carboxylic acids such as acetic acid, wherein the components comprise at least (a) (meth)acrylamide and (b) an organic mercaptan or organic sulphone and effecting oligomerisation is the usual manner.

A preferred form of the oligomer comprises the components (a) (meth)acrylamide, (b) an organic mercaptan or organic sulphone, (c) an ethylenically unsaturated monomer comprising either a tertiary amine group or a quaternary ammonium group and (d) optionally other monomers are mixed with sufficient water and optionally an alcohol, for instance ethanol, and optionally a carboxylic acid, such as acetic acid, to provide an aqueous solution of the monomer blend. Oligomerisation is effected by the use of suitable initiators in the usual manner.

Oligomers formed from any of the organic mercaptans, may be treated with a suitable oxidising agent, for instance a peroxide, especially hydrogen peroxide, in order to convert some or all of the mercapto groups to sulphone groups.

Preparation of the aqueous dispersion of polymeric particles according to the invention may desirably be effected by suspension polymerisation or emulsion polymerisation. In a preferred process the water insoluble monomers, are emulsified into an aqueous medium comprising the oligomer in an amount up to 30% by weight, preferably between 10 and 20% by weight. Polymerisation is effected in the usual way, but may for instance employ the use of redox initiators, thermal initiators, UV radiation or combinations of these. The composition formed will comprise an aqueous dispersion of polymeric particles of particle size up to 1 micron, preferably in the range 80–200 nm, more preferably in the range 100–120 nm wherein the polymeric particles comprise a water insoluble polymer matrix wherein the polymeric particles comprise a water insoluble polymer matrix and at the surface an oligomer formed from a monomer blend comprising, (a) (meth)acrylamide and (b) an organic mercaptan or organic sulphone In a preferred form of the composition the oligomer is formed from a monomer blend comprising, (a) (meth)acrylamide, (b) an organic mercaptan or organic sulphone, (c) an ethylenically unsaturated monomer comprising either a tertiary amine group or a quaternary ammonium group and (d) optionally other monomers.

The following are examples of the invention.

EXAMPLE 1

Preparation of Polymer A 45 parts by weight of styrene and 45 parts by weight of 2-ethylhexyl acrylate is emulsified in 125 parts by weight of water containing 10 parts by weight of an oligomer formed from 20 molar parts acrylamide and 1 molar part dodecyl mercaptan and oligomerised in a 50/50 wt/wt water/ethanol medium. Emulsion polymerisation is effected in the usual manner using redox initiators and a thermal initiator to form a stable dispersion of polymer particles.

Preparation of Polymer B

The process of preparing polymer A is repeated except the oligomer used comprises 19 parts by mole acrylamide, 1 part by mole dodecyl mercaptan and 1 part by mole part of the methyl chloride quaternary ammonium salt of dimethylaminoethyl methacrylate.

Preparation of Polymer C

The process for preparing polymer A is repeated except the oligomer used comprises 19 parts by mole acrylamide, 1 part by mole dodecyl mercaptan and 1 part by mole of methyl chloride quaternary ammonium salt of dimethylaminoethyl methacrylate.

Preparation of Polymer D

The process of preparing polymer A is repeated except the oligomer is prepared in a 50/50 wt/wt water acetic acid solvent.

Preparation of Polymer E

The process for preparing polymer D is repeated except the oligomer used comprises 90 parts by mole acrylamide, 5 parts by mole dodecyl mercaptan and 5 parts by mole of dimethylaminoethyl methacrylate.

Preparation of Polymer F

The process for preparing polymer D is repeated except the oligomer used comprises 92.5 parts by mole acrylamide, 2.5 parts by mole dodecyl mercaptan and 5 parts by mole of dimethylaminoethyl methacrylate.

Preparation of Polymer G

The process for preparing polymer D is repeated except the oligomer used comprises 85 parts by mole acrylamide, 10 parts by mole dodecyl mercaptan and 5 parts by mole of dimethylaminoethyl methacrylate.

Preparation of Polymer H

The process for preparing polymer D is repeated except the oligomer used comprises 93.5 parts by mole acrylamide, 1.5 parts by mole dodecyl mercaptan and 5 parts by mole of dimethylaminoethyl methacrylate.

Preparation of Polymer I

The process for preparing polymer D is repeated except the oligomer used comprises 92.5 parts by mole acrylamide, 5 parts by mole dodecyl mercaptan and 2.5 parts by mole of dimethylaminoethyl methacrylate.

Preparation of Polymer J

The process for preparing polymer D is repeated except the oligomer used comprises 95 parts by mole acrylamide, 5 parts by mole dodecyl mercaptan.

Preparation of Polymer K

The process for preparing polymer D is repeated except the oligomer used comprises 80 parts by mole acrylamide, 5 parts by mole dodecyl mercaptan and 15 parts by mole of dimethylaminoethyl methacrylate.

Preparation of Polymer L

The process for preparing polymer D is repeated except the oligomer used comprises 85 parts by mole acrylamide, 5 parts by mole dodecyl mercaptan and 10 parts by mole of dimethylaminoethyl methacrylate.

Preparation of Polymer M

The process for preparing polymer D is repeated except the oligomer used comprises 90 parts by mole acrylamide, 5 parts by mole dodecyl mercaptan and 5 parts by mole of dimethylaminoethyl methacrylate.

Preparation of Polymer N

The process for preparing polymer D is repeated except the oligomer used comprises 85 parts by mole acrylamide, 5 parts by mole dodecyl mercaptan, 5 parts by mole of dimethylaminoethyl methacrylate and 5 parts by mole acrylic acid.

Preparation of Polymer O

The process for preparing polymer D is repeated except the oligomer used comprises 82.5 parts by mole acrylamide, 5 parts by mole dodecyl mercaptan, 5 parts by mole of dimethylaminoethyl methacrylate and 7.5 parts by mole acrylic acid.

Preparation of Polymer P

The process for preparing polymer D is repeated except the oligomer used comprises 87.5 parts by mole acrylamide, 5 parts by mole dodecyl mercaptan, 5 parts by mole of dimethylaminoethyl methacrylate and 2.5 parts by mole acrylic acid.

Preparation of Polymer Q

The process for preparing polymer N is repeated except that a monomer blend comprising 63 parts by weight of styrene and 27 parts by weight of 2-ethylhexyl acrylate.

Preparation of Polymer R

The Process of preparing polymer Q is repeated except 20 weight % of the oligomer is used.

Preparation of Polymer S

The process of preparing polymer R is repeated except that 0.25 weight % ethyleneglycol dimethacrylate is combined with the styrene/2-ethylhexyl acrylate monomer blend.

Preparation of Polymer T

The process of preparing polymer R is repeated except that 0.50 weight % ethyleneglycol dimethacrylate is combined with the styrene/2-ethylhexyl acrylate monomer blend.

Preparation of Polymer U

The process of preparing polymer R is repeated except that 0.25 weight % divinyl benzene is combined with the styrene/2-ethylhexyl acrylate monomer blend.

Preparation of Polymer V

The process for preparing polymer Q is repeated except the oligomer used is prepared using 5 parts by mole maleic anhydride is used in place of acrylic acid.

EXAMPLE 2

Polymers from example 1 are blended with a pre cooked aqueous 6% starch slurry at a ratio 40:1 starch/polymer to provide a sizing formulation. The sizing formulations are applied to the surface of the paper standard unsized linerboard using a size press with a No. 7 K-bar to give a 5 $gm^{-2}$ coat and dried for 30 minutes at 110° C. in an oven are made by blending each of the polymers of example 1 with a pre cooked starch solution to provide a blend comprising a ratio of 40:1 starch:polymer. The sheets are assessed for a 60 second Cobb test and the results are shown in Table 1.

TABLE 1

| Polymer | Average Cobb Test $gm^{-2}$ |
|---|---|
| A | 22.1 |
| D | 17.2 |
| E | 22.6 |
| F | 22.0 |
| G | 25.9 |
| H | 24.1 |
| I | 21.5 |
| J | 21.3 |
| K | 23.8 |
| L | 22.5 |
| M | 21.8 |
| N | 25.6 |
| O | 25.1 |
| Q | 21.6 |
| R | 20.2 |
| S | 19.6 |
| T | 20.1 |
| U | 19.1 |
| V | 20.9 |

As can be seen from the results all of the products give acceptable water resistance to the sheet. Particularly good results are obtained from formulations comprising polymers B, I, J, M, Q, R, S, T, U and V

EXAMPLE 3

Polymers from example 1 are blended with an aqueous 6% starch slurry at a ratio of 20:1 starch/polymer. The blends are coated onto UMIST paper sheets at a dose of 5 $gm^{-2}$. Printability tests are obtained using a Hewlett Packard Deskjet 560C printer. The Black Optical Density and Colour Density were measured on paper coated using the respective products. The results are presented in Table 2

OD—Optical Density

CD—Colour Density

Deskjet is a trade mark of Hewlett Packard.

TABLE 2

| POLYMER | CD Cyan | CD Green | CD Yellow | CD Blue | CD Magenta | CD Red | Pass/ Fail | Com Black OD min |
|---|---|---|---|---|---|---|---|---|
| A | 2 | 2 | 1 | 4 | 1 | 1 | Pass | 1.386 |
| B | 2 | 2 | 0 | 4 | 1 | 1 | Pass | 1.332 |
| C | 2 | 2 | 0 | 3 | 1 | 1 | Pass | 1.356 |
| D | 2 | 3 | 0 | 3 | 1 | 1 | Pass | 1.39 |
| N | 2 | 2 | 1 | 4 | 1 | 2 | Pass | 1.412 |
| O | 2 | 2 | 1 | 4 | 1 | 2 | Pass | 1.420 |
| P | 2 | 2 | 1 | 4 | 1 | 2 | Pass | 1.430 |
| Q | 2 | 1 | 2 | −1 | 1 | 2 | Pass | 1.353 |

As can be seen all of the polymers gave acceptable results.

EXAMPLE 4

The 20:1 starch/polymer formulations of example 3 are coated onto UMIST standard paper sheets and standard brightness tests are carried out. The results of the tests are shown in Table 3.

TABLE 3

| Surface Size | Brightness |
|---|---|
| Starch only | 75.75 |
| Starch + OBA + Polymer A | 82.58 |
| Starch + OBA + Polymer B | 82.06 |
| Starch + OBA + Polymer C | 82.62 |
| Starch + OBA + Polymer D | 82.83 |
| Starch + OBA + Polymer I | 81.0 |
| Starch + OBA + Polymer J | 80.6 |
| Starch + OBA + Polymer K | 81.1 |
| Starch + OBA + Polymer L | 81.3 |
| Starch + OBA + Polymer M | 81.5 |
| Starch + OBA + Polymer N | 83.39 |

The polymers of the current invention gave a high degree of brightness. Best results were obtained using polymers A,B,C,D and N.

EXAMPLE 5

Polymers D and Q from example 1 are blended with a pre cooked aqueous 6% starch slurry at a ratio of 40:1 starch/polymer to provide various sizing formulation of different pHs. The sizing formulations are applied to the surface of the standard linerboard as in example 2. Water resistance of the sized paper is measured using 60 second Cobb test. The results are shown in Tables 4 and 5

TABLE 4

| | Cobb Value ($gm^{-2}$) | | | | | | | | |
|---|---|---|---|---|---|---|---|---|---|
| Formulation | pH 1.7 | pH 2.9 | pH 4.1 | pH 5.8 | pH 6.7 | pH 7.6 | pH 9.2 | pH 10.2 | pH 11.5 |
| Polymer D | 21.2 | 21.0 | 20.6 | 21.3 | 21.1 | 22.0 | 20.6 | 20.7 | 21.9 |

TABLE 5

| | Cobb Value ($gm^{-2}$) | | | | | |
|---|---|---|---|---|---|---|
| Formulation | pH 1.5 | pH 3.6 | pH 7.1 | pH 9.2 | pH 10.3 | pH 11.7 |
| Polymer Q | 19 | 18.1 | 19.3 | 18.8 | 18.3 | 18.8 |

The results of this test demonstrate that the polymers provide the paper with good water resistance at acid, neutral or alkaline pHs.

EXAMPLE 6

Polymer Q was added as the aqueous emulsion directly to two types of papermaking stock and the formed paper sheets were tested for water resistance.

| | Cobb Value ($gm^{-2}$) | | | |
|---|---|---|---|---|
| dose (Kg/T) | 2 | 4 | 8 | 12 |
| Waste Furnish | 185 | 74 | 34 | 25 |
| Fine Furnish | 188 | 44 | 24 | 26 |

As can be seen the use of the polymers of the invention as internal sizing agents shows good water resistance properties on two different types of stock.

The results of all of these examples clearly demonstrate that the products of the invention provide paper with good water resistance, printability and brightness.

What is claimed is:

1. A method of sizing paper or paper board by applying a composition (A) to at least one of, i) the surface of a formed paper or paper board sheet, ii) a paper or paper board making cellulosic suspension prior to draining, wherein the composition (A) comprises an aqueous dispersion of polymeric particles of particle size up to 1 micron, wherein the polymeric particles comprise a water insoluble polymer matrix, comprised of ethylenically unsaturated monomer or ethylenically unsaturated monomer blend, wherein an oligomer formed from a monomer blend comprising, (a) (meth)acrylamide, (b) an organic mercaptan or organic sulphone, and (c) an ethylenically unsaturated monomer comprising either a tertiary amine group or a quaternary ammonium group is located at the surface of the polymer particles.

2. A method according to claim 1 wherein component (b) is selected from the group consisting of $C_{8-20}$ alkyl mercaptans, $C_{5-7}$ cycloalkyl mercaptans, aromatic mercaptans, $C_{8-20}$ alkyl sulphones, $C_{5-7}$ cycloalkyl mercaptans and aromatic sulphones.

3. A method according to claim 1 wherein component (c) comprises a compound of formula (1)

$$CH_2{=}CR{-}Q \quad (1),$$

wherein

Q is $-C(O)-Z-A$, $-CH_2-N^+R_1R_3CH_2CR{=}CH_2\ X^-$ or $-CH_2NR_1CH_2CR{=}CH_2$,

Z is —O— or —NH—,

A is $-C_nH_{2n}-B-$, n is an integer from 1 to 4,

B is $-NR_1R_2$ or $-N^+R_1R_2R_3\ X^-$,

R is —H or $-CH_3$, $R_1$ is $C_{1-4}$ alkyl, $R_2$ is $C_{1-4}$ alkyl, $R_3$ is —H or $C_{1-8}$ alkyl, $C_{5-7}$ cycloalkyl or benzyl, and $X^-$ is anion.

4. A method according to claim 1 wherein component (c) is dimethylaminoethyl (meth)acrylate, acid addition salt or quaternary ammonium salt thereof.

5. A method according to claim 1 wherein the oligomer comprises at least 85 mole % of component (a).

6. A method according to claim 1 wherein the oligomer further comprises component (d) which is an ethylenically unsaturated carboxylic acid or an ethylenically unsaturated carboxylic anhydride in an amount up to 10 mole %.

7. A method according to claim 6 wherein component (d) is acrylic acid or maleic anhydride and is present in an amount between 2.5 and 5 mole %.

8. A method according to claim 1 wherein the matrix of the polymeric particles are formed from a monomer or a monomer blend comprising monomers selected from the group consisting of styrene, $C_{1-12}$ alkyl (meth)acrylate, vinyl acetate and acrylonitrile.

9. A method according to claim 1 wherein the matrix of the polymer particles is formed from 25–75 weight % of a monomer or monomer blend selected from the group consisting of styrene, acrylonitrile, vinyl acetate and $C_{1-2}$ alkyl (meth)acrylates, and 25–75 weight % of a monomer or monomer blend selected from $C_{3-8}$ alkyl (meth)acrylates.

10. A method according to claim 1 wherein the matrix of the polymer particles is formed from 25–75 weight % styrene and 25–75 weight % 2-ethylhexyl acrylate.

11. A method according to claim 1 wherein the polymer particles are formed from a monomer blend comprising a cross linking monomer.

12. A method according to claim 1 wherein the polymer particles have a minimum film forming temperature of between −5 and 55° C.

13. A method according to claim 1 wherein the polymer particles have a particle size in the range 80–200 nm.

14. A method according to claim 1 wherein the composition (A) comprises 0.5 to 10 weight % polymer particles and 90 to 99.5 weight % starch based on total dry weight of polymer particles and starch.

15. A method of improving printability of a sheet of paper by applying to the surface of the formed paper sheet a composition comprising an oligomer formed from a monomer blend comprising, (a) (meth)acrylamide, (b) an organic mercaptan or organic sulphone, (c) an ethylenically unsaturated monomer comprising either a tertiary amine group or a quaternary ammonium group, and optionally (d) 0–10 mole% other ethylenically unsatured monomers.

16. A method according to claim 15 wherein the composition comprises an aqueous dispersion of polymeric particles of particle size up to 1 micron, wherein the polymeric particles comprise a water insoluble polymer matrix, and the oligomer is located at the surface of the polymer particles.

17. A method according to claim 15 wherein the oligomer is formed from a monomer blend comprising, (a) 85–95 mole % (meth)acrylamide, (b) 2.5–10 mole % of an organic mercaptan or an organic sulphone, (c) 2.5–10 mole % of an ethylenically unsaturated monomer comprising either a tertiary amine group or a quaternary ammonium group, and (d) 0–10 mole % other ethylenically unsaturated monomers.

18. A method according to claim 15 wherein the composition comprises 0.5 to 10 weight % polymer particles and 90 to 99.5 weight % starch based on total dry weight of polymer particles and starch.

19. A method according to claim 15 wherein the composition comprises optical brightening aids.

20. A composition comprising an aqueous dispersion of polymeric particles of particle size up to 1 micron, wherein the polymeric particles comprise a water insoluble polymer matrix, characterized in that an oligomer formed from a monomer blend comprising, (a) 85–95 mole % (meth)acrylamide and (b) 2.5–10 mole % of an organic mercaptan or an organic sulphone, and (c) 2.5–10 mole % of an ethylenically unsaturated monomer comprising either a tertiary amine group or a quaternary ammonium group, and (d) 0–10 mole % other ethylenically unsaturated monomers, preferably acrylic acid or maleic anhydride, is located at the surface polymer particles.

21. A composition according to claim 19, wherein the polymeric particles have a particle size of 80–200 nm.

22. A composition according to claim 20, wherein component (b) is dodecyl mercaptan or dodecyl sulphone, present in an amount of 2.5–5 mole % based on total oligomer.

23. A composition according to claim 20, wherein component (c) is dimethylaminoethyl methacrylate, present in an amount of 2.5–5 mole % based on total oligomer.

24. A composition according to claim 20, wherein component (d) is acrylic acid or maleic anhydride, present in an amount of 2.5–5 mole % based on total oligomer.

* * * * *